US008920254B2

(12) United States Patent
Ivory et al.

(10) Patent No.: US 8,920,254 B2
(45) Date of Patent: Dec. 30, 2014

(54) ANTI-WRAP SWING HANGER AND SWING ASSEMBLY

(71) Applicant: Playworld Systems, Inc., Lewisburg, PA (US)

(72) Inventors: Christopher L. Ivory, Mifflinburg, PA (US); Gregory M. Lannan, Turbotville, PA (US); Nickolas T. Cipriani, Jr., Loganton, PA (US); Jonathan T. Foster, Watsontown, PA (US)

(73) Assignee: Playworld Systems, Inc., Lewisburg, PA (US)

( * ) Notice: Subject to any disclaimer, the term of this patent is extended or adjusted under 35 U.S.C. 154(b) by 78 days.

(21) Appl. No.: 13/797,195

(22) Filed: Mar. 12, 2013

(65) Prior Publication Data

US 2014/0274429 A1 Sep. 18, 2014

(51) Int. Cl.
*A63G 9/12* (2006.01)
*A63G 9/02* (2006.01)

(52) U.S. Cl.
CPC ..... *A63G 9/12* (2013.01)
USPC ..... 472/118

(58) Field of Classification Search
USPC ..... 472/118, 119, 120, 121, 122, 123, 124, 472/125; 403/78, 164
See application file for complete search history.

(56) References Cited

U.S. PATENT DOCUMENTS

| | | | | |
|---|---|---|---|---|
| 2,728,617 | A * | 12/1955 | Edwards | 384/512 |
| 3,233,894 | A | 2/1966 | Binan | |
| 3,874,375 | A | 4/1975 | Penner | |
| 4,138,104 | A | 2/1979 | D'Amicis | |
| D258,115 | S * | 2/1981 | Piatek | D8/373 |
| 6,123,480 | A | 9/2000 | Petty et al. | |
| 6,277,028 | B1 | 8/2001 | Liu | |
| 6,669,394 | B1 * | 12/2003 | Rieber et al. | 403/164 |
| 6,830,517 | B1 | 12/2004 | Ciraolo | |
| 8,376,294 | B2 * | 2/2013 | Steury et al. | 248/202.1 |
| 2009/0105002 | A1 | 4/2009 | Kahn et al. | |

* cited by examiner

*Primary Examiner* — Kien Nguyen

(57) ABSTRACT

An anti-wrap swing assembly includes a swing hanger having an elongate body that extends longitudinally along an axis and defines a channel. The swing hanger further includes a pair of lugs that extend from the elongate body transverse to the axis and are spaced apart from each other by a predetermined distance, each lug defining a bore. The assembly also includes a swing flexibly coupled to the swing hanger. Additionally, the assembly includes a frame having a top rail with a substantially tubular body that is partially disposed within the channel of the swing hanger and a pair of rivets coupled to the substantially tubular body. The frame also includes at least a pair of legs extending from the top rail transverse to the axis and configured to support the top rail.

14 Claims, 4 Drawing Sheets

ANTI-WRAP SWING HANGER AND SWING ASSEMBLY

BACKGROUND

Existing swing assemblies typically include a frame and a swing mounted to the frame by two collars. Each of the collars is fixedly mounted to a top rail of the frame to couple a chain of the swing to the top rail. These collar configurations are advantageous because a relatively small amount of metal is required to connect the chains to the top rail. Further, these collars are often bolted to the top rail, which provides for easy replacement and flexible positioning.

The existing collar configurations can also create a playground maintenance nuisance. Specifically, because the collars are fixedly mounted on the top rail, it is possible to wrap the swing and chain about the top rail, rendering it unsafe or even unusable. When swings are wrapped about the top rail (often by playground vandals), a maintenance worker needs to unwrap the swing and chain. The anti-wrap swing hanger and swing assembly disclosed herein presents a solution to this maintenance nuisance.

SUMMARY

As described herein, an anti-wrap swing assembly includes a swing hanger having an elongate body that extends longitudinally along an axis and defines a channel. The swing hanger further includes a pair of lugs that extend from the elongate body transverse to the axis and are spaced apart from each other by a predetermined distance, each lug defining a bore. The swing hanger also may also have a pair of bolts, each bolt extending through a respective bore and a pair of shackles, each shackle coupled to one lug of the pair of lugs by the pair of bolts, respectively. The swing hanger assembly also includes a swing flexibly coupled to the swing hanger by the pair of shackles and a frame. The frame includes a top rail having a substantially tubular body that extends longitudinally along the axis and is partially disposed within the channel of the swing hanger and a pair of rivets coupled to the substantially tubular body and extending from the substantially tubular body transverse to the axis, each of the rivets being disposed about the swing hanger so as to minimize motion of the swing hanger relative to the substantially tubular body along the axis. The frame also includes at least a pair of legs extending from the top rail transverse to the axis and configured to support the top rail.

In accordance with one embodiment, an anti-wrap swing hanger and top rail assembly includes an swing hanger having an elongate body that extends longitudinally along an axis and defines a channel; the swing hanger further comprising a pair of lugs that extend from the elongate body transverse to the axis and are spaced apart from each other by a predetermined distance, each lug defining a bore. The swing hanger further includes a pair of bolts, each bolt extending through a respective bore and a pair of shackles, each shackle coupled to one lug of the pair of lugs by the pair of bolts, respectively and configured to flexibly couple a swing to the swing hanger. The anti-wrap swing hanger and top rail assembly also has a top rail with a substantially tubular body that extends longitudinally along the axis and is partially disposed within the channel of the swing hanger. The top rail further includes a pair of rivets coupled to the substantially tubular body and extending from the substantially tubular body transverse to the axis, each of the rivets being disposed about the swing hanger so as to minimize motion of the swing hanger relative to the substantially tubular body along the axis.

In accordance with another embodiment, a method of retrofitting a swing assembly having a top rail supported by a pair of legs with an anti-wrap swing hanger and top rail assembly includes a step of cutting a portion of the top rail of the swing assembly. The method further includes a step of forming a pair of flanges that extend parallel to an axis away from the pair of legs, respectively. The method also includes removing the portion of the top rail. Additionally, the method includes a step of bolting the anti-wrap swing hanger and top rail assembly to the flanges.

BRIEF DESCRIPTION OF THE DRAWINGS

The foregoing summary, as well as the following detailed description of embodiments of the application, will be better understood when read in conjunction with the appended drawings. For the purposes of illustrating the methods and systems of the present application, there is shown in the drawings preferred embodiments. It should be understood, however, that the application is not limited to the precise methods and systems shown. In the drawings.

DETAILED DESCRIPTION

Figure 1:
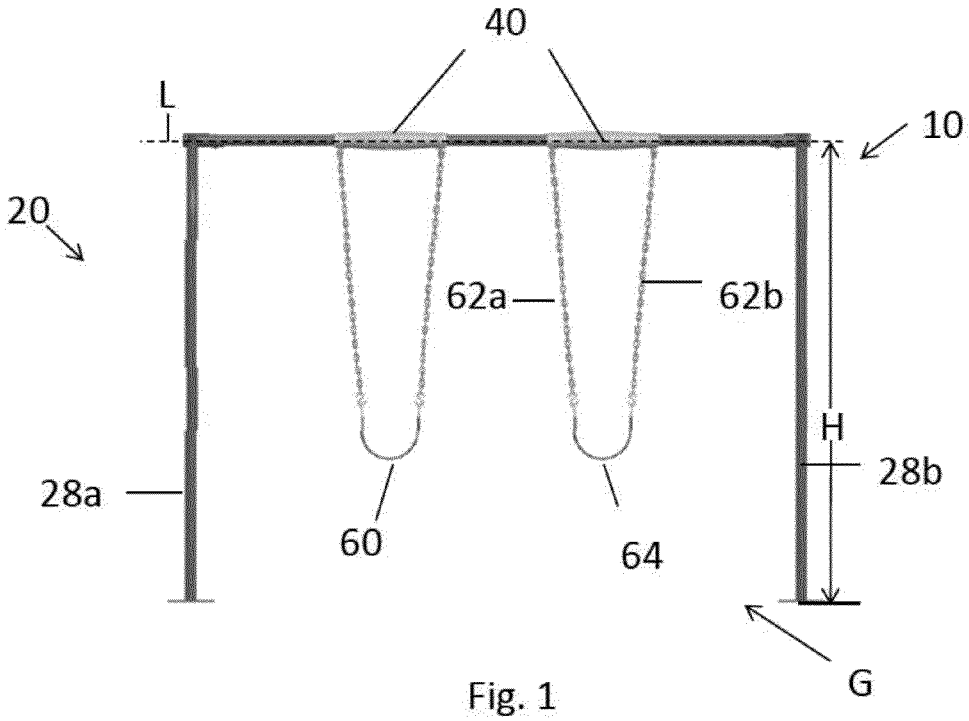
FIG. 1 is a side view of an anti-wrap swing assembly, including two swing hangers that are each coupled to a swing and mounted to a frame.

Certain terminology is used in the following description for convenience only and is not limiting. The words "right", "left", "top", or "bottom" designate directions in the drawings to which reference is made. The words "proximally" and "distally" refer to directions toward and away from, respectively, the individual operating the display unit. The terminology includes the above-listed words, derivatives thereof and words of similar import.

Referring to FIG. 1, an anti-wrap swing assembly 10 can include a frame 20 that is configured to be installed in a recreational area. For example, the frame 20 may be secured to the ground of the recreational area in cement-filled holes. The anti-wrap swing assembly 10 further includes at least one swing hanger 40 that is mounted on the frame and configured to couple to a swing 60. The embodiment shown in FIG. 1 depicts two swing hangers 40 mounted on the frame. Alternatively, a single swing hanger 40 may be mounted on the frame. Other embodiments may include more than two swing hangers 40 on the frame. In embodiments where more than two swing hangers 40 are mounted on the frame, additional support structure may be added between sets of swing hangers along the top rail.

The frame 20 includes a top rail 22 that has a body 24, such as a substantially tubular body, that extends along an axis L. The body 24 has a left end 24*a* and a right end 24*b* that opposes the left end 24*a* along axis L. The frame 20 further includes at least one pair of legs 28*a,b* connected to the ends 24*a,b* of the body 24, respectively. Specifically, as shown in FIG. 1, a left leg 28*a* extends away from the top rail 22, transverse to axis L. A right leg 28*b* also extends away from top rail 22, transverse to axis L. Legs 28*a,b* may be welded to top rail 22 during installation of the anti-wrap swing assembly 10. In the embodiment illustrated in FIG. 1, each of the legs 28*a,b* extend substantially perpendicularly to axis L and a plane G defined by the ground of the recreational area such that legs 28*a,b* support the top rail 22 at a height H defined by the distance between axis L and plane G.

Figure 4:
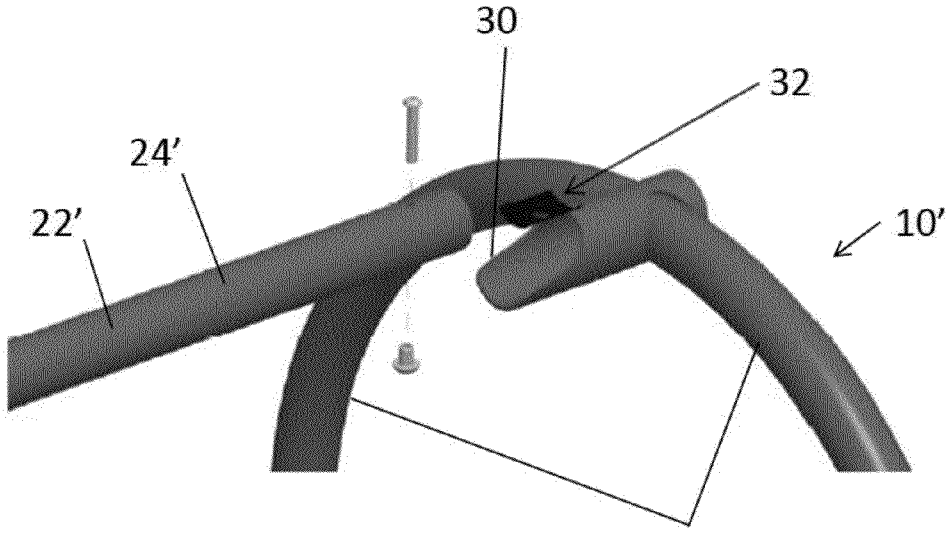
FIG. 4 is an exploded perspective view of a portion of a frame of an anti-wrap swing assembly.
Figure 5A:
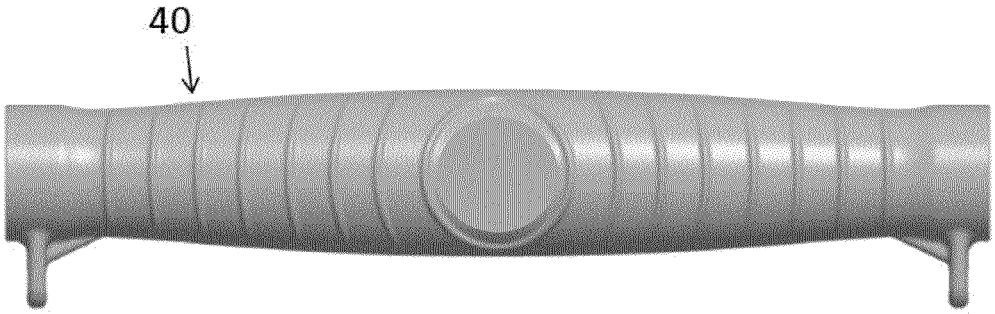
FIG. 5A is a front view of a swing hanger.
Figure 5B:
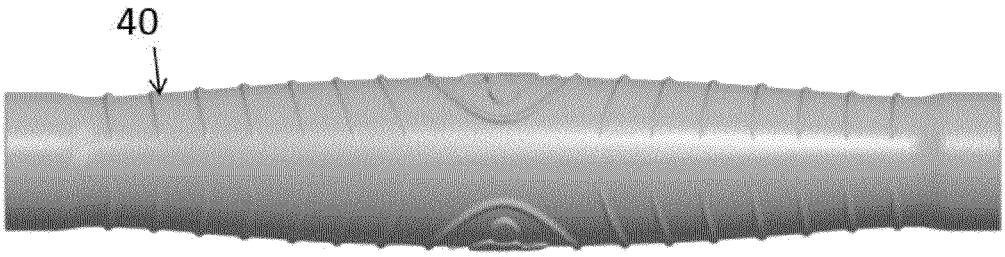
FIG. 5B is a top view of a swing hanger.
Figure 5C:
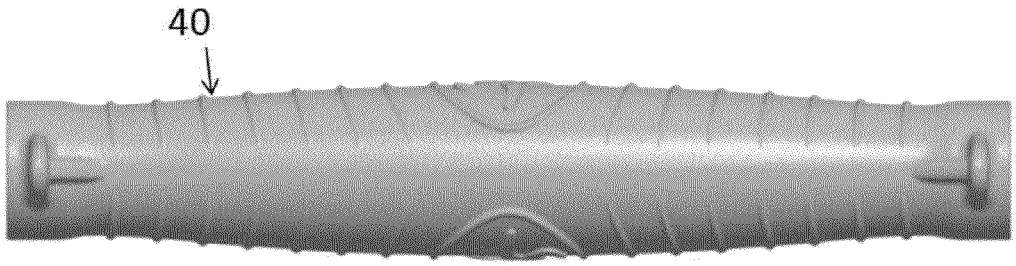
FIG. 5C is a bottom view of a swing hanger.
Figure 5D:
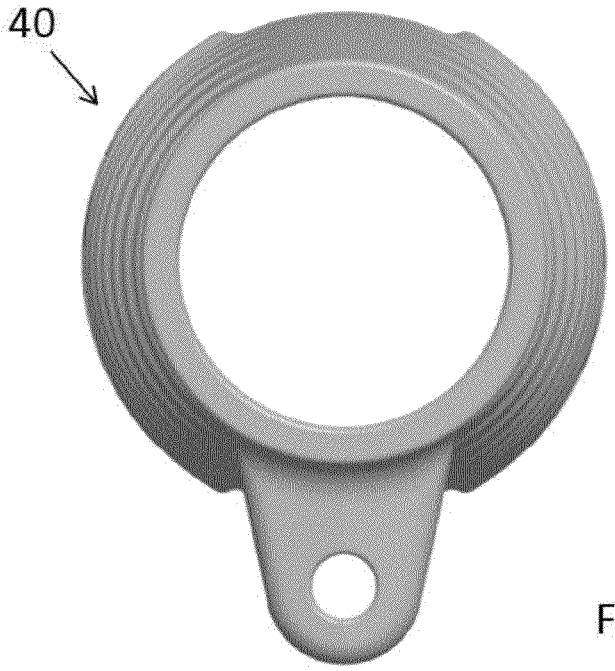
FIG. 5D is a right side view of a swing hanger, the left side view of the swing hanger being identical to the right side view.
Figure 5E:
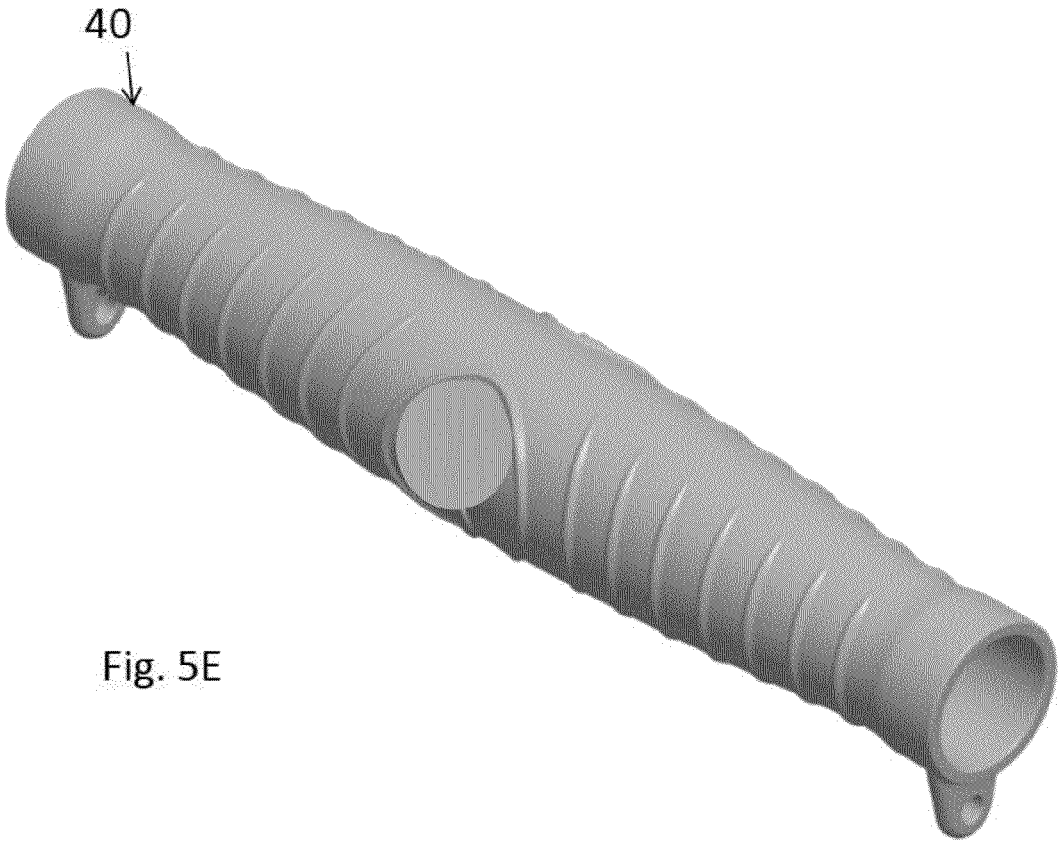
FIG. 5E is a perspective view of a swing hanger.

With reference to FIG. 4, multiple pairs of legs, such as two pairs of legs 28*a,b* can connect to the top rail 22 to support the top rail 22 at height H. For example, instead of a single leg 28*b* that extends perpendicularly between the top rail 22 and plane G, legs 28*b* may extend at an angle other than 90°, or partially at such an angle. FIG. 4 depicts legs 28*b* extending from top rail 22 along a curve. The legs may extend from top rail 22 along a curve relative to axis L to a point and then extend perpendicular to plane G. Alternatively, the legs may extend straight and at an angle other than 90° relative to axis L and plane G.

Figure 2A:
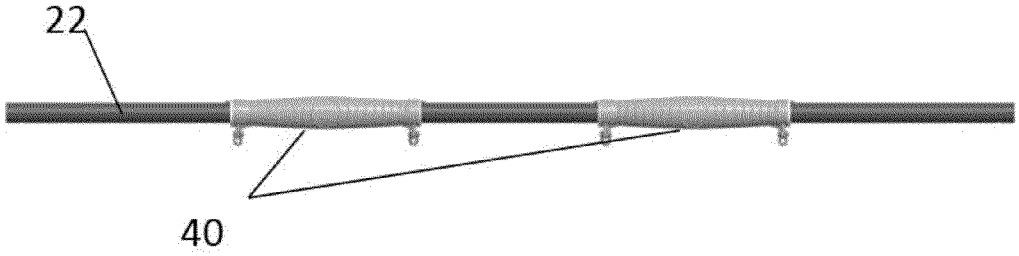
FIG. 2A is a side view of a portion of the anti-wrap swing assembly shown in FIG. 1.
Figure 2B:
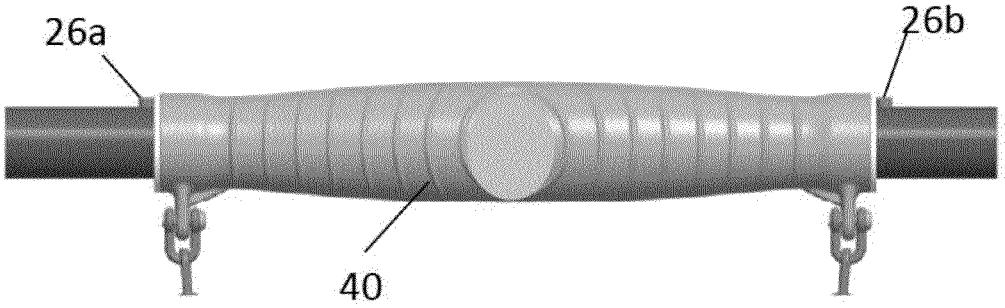
FIG. 2B is a side view of a portion of the anti-wrap swing assembly shown in FIGS. 1 and 2A.
Figure 3:
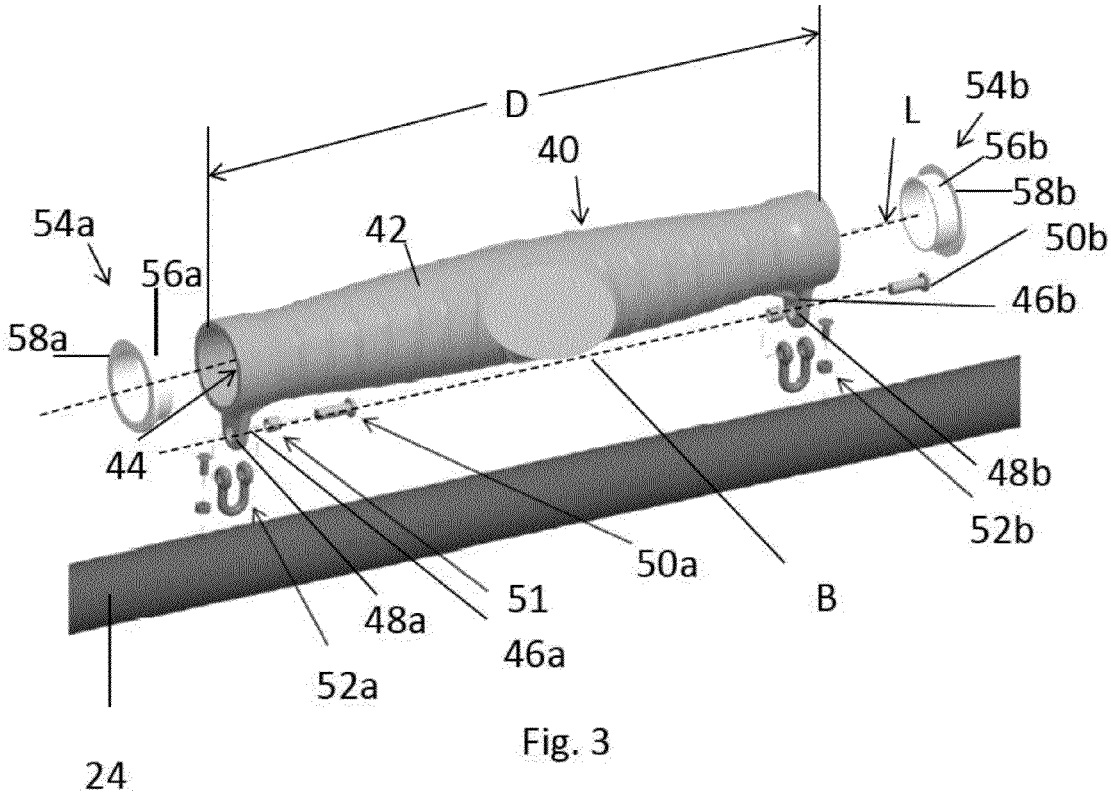
FIG. 3 is am exploded view of the portion of the anti-wrap swing assembly shown in FIG. 2B.

Referring now to FIG. 2B, the top rail 22 further includes at least one pair of rivets 26*a,b* that extend from the top of body 24 transverse to axis L. The pair of rivets 26*a,b* is disposed about the swing hanger 40 on either side. Rivets 26*a,b* are configured to minimize motion of the swing hanger 40 relative to the body 24 along axis L. In alternative embodiments, the top rail 22 may be otherwise configured to minimize motion of the swing hanger along axis L. For example, rivets 26*a,b* may be disposed on the bottom of body 24. Alternatively, multiple pairs of rivets may be used to secure the swing hanger 40. In addition to, or alternatively to rivets, the top rail 22 may have other types of protrusions that extend relative to axis L at a greater distance than at least a portion of the swing hanger 40. Other embodiments may use a sleeve disposed about the top rail 22 between the swing hanger 40 and the legs 28*a,b* or between one swing hanger 40 and another swing hanger.

As shown in FIGS. 3 and 5A-5E, the swing hanger 40 includes a body 42 that is elongate along axis L. The body 42 defines a channel 44 in which at least a portion of the top rail 22 of the frame 20 is disposed. The body 42 has a left end 42*a* and a right end 42*b* that opposes left end 42*a* along axis L. The body 42 extends between the left end 42*a* and the right end 42*b* substantially parallel to axis L. In the embodiment shown in the figures, the body 42 curves radially outward from axis L as it extends from the two ends 42*a,b*, such that a middle portion of the body defines a portion of the channel that has a greater cross-sectional area than the portions of the channel defined by the two ends 42*a,b*.

The swing hanger further includes a pair of lugs 46*a,b* that extend from ends 42*a,b* of the body 42, respectively, transverse to axis L. The lugs 46*a,b* are positioned relative to each other along the body 42 at a predetermined distance D. For example, distance D may be determined based on ASTM 1487 §8.6.1.5. In other words, distance D may be a distance that is greater than the width of the seat when occupied, for example by an object weighing 24.4 pounds (11.3 kg) and having a maximum width of 6.7 inches (170 mm). Alternatively, the distance may be a distance that is greater than 20 inches (508 mm). Each of the lugs 46*a,b* define a bore 48*a,b* that extends through the lug 46*a,b* along an axis B. Axis B may be substantially parallel to axis L. Alternatively, each of bores 48*a,b* may extend along axes that are not substantially parallel to axis L. The body 42 and lugs 46*a,b* may be formed integrally, for example, from casting such as an aluminum casting.

Swing hanger 40 can further include a pair of bolts 50*a,b* that each extend through the pair of bores 48*a,b*. A bolt bushing 51 may be disposed within each bore 48*a,b* and about each bolt 50*a,b*. Bolt bushing 51 may be an oil filled bronze bushing. Bolt bushing 51 functions to minimize friction between the lug 46*a,b* and the bolt 50*a,b*, as each of the lug 46*a,b* and the bolt 50*a,b* rotate relative to one another. Each bolt 50*a,b* secures a shackle 52*a,b*, respectively, to the respective lug 46*a,b* of the body 42. Shackles 52*a,b* can be substantially U-shaped and can each include a pair of bores through which the bolt is disposed.

The swing hanger 40 also includes a pair of hanger bushings 54*a,b* disposed within the channel 44 about the top rail 22. Hanger bushings 54*a,b* can include a body 56*a,b* that extends into the channel 44 about the top rail 22 and a lip 58*a,b* that extends from the body 56*a,b* transverse to axis L to form an annular ring proximate a respective end 42*a,b* of the body 42. Hanger bushings 54*a,b* may be made of an ultra-high molecular weight polyethylene. Hanger bushings 54*a,b* function to minimize friction between the top rail 22 and the swing hanger 40 as the swing hanger rotates relative to the top rail.

Referring back to FIG. 1, the swing 60 can include a pair of chains 62*a,b* that are each, respectively, coupled to the swing hanger 40. The embodiment shown depicts each of the chains 62*a,b* flexibly coupled to the swing hanger. Chains 62*a,b* may be galvanized. Chains 62*a,b* connect a seat 64 to the swing hanger 40. FIG. 1 depicts a standard U-shaped swing seat. However, multiple types of seats can be attached to the swing hanger 62. For example, a toddler swing seat may be attached. Alternatively, an accessible swing seat with a rollercoaster-style safety harness may be attached. Because the accessible swing seat can have two pairs of chains, the arrangement described above for attaching the pair of chains 62*a,b* to the swing hanger 40. For example, the chains on the respective right and left sides of the swing may each be connected to a single chain that is then connected to the right or left side of the swing hanger 40. Alternatively, the swing hanger 40 may be modified to include two lugs 46*a,b* on either side of the body 42, such that each of the four lugs can be coupled to the four chains of the accessible swing seat.

During use, a person, such as a child, sitting in the seat 64 rotates with the seat about axis L. Unlike prior art collars that fixedly connect the top rail and the chain, the swing hanger 40 rotates with the seat 64 and chains 62*a,b* about axis L. Rivets 26*a,b* minimize motion of the swing hanger 40 along axis L. Because swing hanger 40 is rotatable about top rail 22, the seat 64 and chains 62*a,b* are not readily wrappable about the top rail 22. In this way, the anti-wrap swing assembly 10 described herein is thought to minimize or prevent the ability of a person to wrap a swing about its frame.

Anti-wrap swing assembly 10 may be installed as an entirely new assembly or, alternatively, an existing swing assembly may be retrofitted to create an anti-wrap swing assembly. FIG. 4 also depicts an existing swing assembly that has been retrofitted to create an anti-wrap swing assembly 10. As shown, a portion of the top rail of an existing swing assembly may be cut so that an anti-wrap swing hanger and top rail assembly 10' may be installed. Depending on the specific installation, top rail 22' of the anti-wrap swing hanger and top rail assembly 10' may have a length that is relatively shorter than other top rails. Top rail 22' has rivets (not shown) and is otherwise substantially similar to top rail 22 and has a body 24', such as a substantially tubular body, that extends along an axis L. The body 24' has a left end (not shown) and a right end 24*b*' that opposes the left end along axis L.

In the embodiment shown, the existing top rail has been cut on each end to form flanges 30 that extend parallel to axis L away from the respective left and right sides of the existing swing assembly. Top rail 22' may be bolted at each of the left end and the right end 24*b*' to the flange. A piece of rubber 32, or other friction creating material, may be disposed between the flange 30 and the top rail 22' to minimize rotation of the top rail 22' relative to the flange 30 and to also minimize noise caused by such rotation.

While the foregoing description and drawings represent the preferred embodiment of the present invention, it will be understood that various additions, modifications, combinations and/or substitutions can be made therein without departing from the spirit and scope of the invention as defined in the accompanying claims. In particular, it will be clear to those skilled in the art that the invention can be embodied in other specific forms, structures, arrangements, proportions, and with other elements, materials, and components, without departing from the spirit or essential characteristics thereof. One skilled in the art will appreciate that the invention can be used with many modifications of structure, arrangement, proportions, materials, and components, which are particularly adapted to specific environments and operative requirements without departing from the principles of the invention. In addition, features described herein can be used singularly or in combination with other features. For example, features described in connection with one component can be used and/or interchanged with features described in another component. The presently disclosed embodiment is therefore to be considered in all respects as illustrative and not restrictive, the scope of the invention being indicated by the appended claims, and not limited to the foregoing description.

It will be appreciated by those skilled in the art that various modifications and alterations of the invention can be made without departing from the broad scope of the appended claims. Some of these have been discussed above and others will be apparent to those skilled in the art.

What is claimed:

1. An anti-wrap swing assembly comprising:

a swing hanger having an elongate body that extends longitudinally along an axis and defines a channel; the swing hanger further comprising a pair of lugs that extend from the elongate body transverse to the axis and are spaced apart from each other by a predetermined distance, each lug defining a bore; the swing hanger further comprising:

a pair of bolts, each bolt extending through a respective bore; and a pair of shackles, each shackle coupled to one lug of the pair of lugs by the pair of bolts, respectively;

a swing flexibly coupled to the swing hanger by the pair of shackles; and a frame, the frame including:

a top rail having a substantially tubular body that extends longitudinally along the axis and is partially disposed within the channel of the swing hanger;

the top rail further comprising a pair of rivets coupled to the substantially tubular body and extending from the substantially tubular body transverse to the axis, each of the rivets being disposed about the swing hanger so as to minimize motion of the swing hanger relative to the substantially tubular body along the axis; and at least a pair of legs extending from the top rail transverse to the axis and configured to support the top rail.

2. The anti-wrap swing assembly of claim 1, wherein the swing hanger further comprises at least one bushing that is disposed about the top rail and within the channel.

3. The anti-wrap swing assembly of claim 2, wherein the at least one bushing includes two bushings that are each disposed within the channel proximate a respective lug.

4. The anti-wrap swing assembly of claim 3, wherein the two bushings are comprised of an ultra-high molecular weight polyethylene.

5. The anti-wrap swing assembly of claim 1, wherein the elongate body and the lug are integrally formed of a unitary casting.

6. The anti-wrap swing assembly of claim 1, wherein the axis is a first axis and each of the bores extend along a second axis that is substantially parallel to the first axis.

7. The anti-wrap swing assembly of claim 1, wherein the at least a pair of legs includes two legs that each extend perpendicularly relative to the axis.

8. The anti-wrap swing assembly of claim 1, wherein the at least a pair of legs includes four legs.

9. The anti-wrap swing assembly of claim 1, wherein the at least a pair of legs includes six legs.

10. An anti-wrap swing hanger and top rail assembly comprising:

an swing hanger having an elongate body that extends longitudinally along an axis and defines a channel; the swing hanger further comprising a pair of lugs that extend from the elongate body transverse to the axis and are spaced apart from each other by a predetermined distance, each lug defining a bore; the swing hanger further comprising:

a pair of bolts, each bolt extending through a respective bore; and a pair of shackles, each shackle coupled to one lug of the pair of lugs by the pair of bolts, respectively and configured to flexibly couple a swing to the swing hanger;

a top rail having a substantially tubular body that extends longitudinally along the axis and is partially disposed within the channel of the swing hanger;

the top rail further comprising a pair of rivets coupled to the substantially tubular body and extending from the substantially tubular body transverse to the axis, each of the rivets being disposed about the swing hanger so as to minimize motion of the swing hanger relative to the substantially tubular body along the axis.

11. The anti-wrap swing hanger and top rail assembly of claim 10, wherein the swing hanger further comprises at least one bushing that is disposed about the top rail and within the channel.

12. The anti-wrap swing hanger and top rail assembly of claim 11, wherein the at least one bushing includes two bushings that are each disposed within the channel proximate a respective lug.

13. The anti-wrap swing hanger and top rail assembly of claim 10, wherein the elongate body and the lug are integrally formed of a unitary casting.

14. The anti-wrap swing hanger and top rail assembly of claim 10, wherein the axis is a first axis and each of the bores extend along a second axis that is substantially parallel to the first axis.

* * * * *